US006975235B2

(12) United States Patent
Determan et al.

(10) Patent No.: US 6,975,235 B2
(45) Date of Patent: Dec. 13, 2005

(54) TEMPERATURE WARNING SYSTEM FOR A FIREPLACE

(75) Inventors: Bradley Dean Determan, Lakeville, MN (US); Thomas J. Bachinski, Lakeville, MN (US); David J. Oja, Burnsville, MN (US)

(73) Assignee: HON Technology Inc., Muscatine, IA (US)

( * ) Notice: Subject to any disclaimer, the term of this patent is extended or adjusted under 35 U.S.C. 154(b) by 31 days.

(21) Appl. No.: 10/119,474

(22) Filed: Apr. 9, 2002

(65) Prior Publication Data

US 2003/0201896 A1 Oct. 30, 2003

(51) Int. Cl.[7] ..... G08B 17/00

(52) U.S. Cl. ..... 340/584; 340/577; 340/578; 340/586; 340/588

(58) Field of Search ..... 340/584, 577, 340/578, 588, 628, 629, 630, 632

(56) References Cited

U.S. PATENT DOCUMENTS 4,095,067 A 6/1978 LaScola
4,388,520 A 6/1983 McWilliams
4,544,831 A 10/1985 Bayer
4,793,322 A 12/1988 Shimek et al.
4,916,436 A 4/1990 Silliman et al.
5,076,254 A 12/1991 Shimek et al.
5,231,377 A * 7/1993 Clark ..... 340/584
6,053,165 A 4/2000 Butler et al.
6,069,566 A * 5/2000 Guatta ..... 340/584
6,075,445 A 6/2000 McLoughlin et al.
6,087,944 A * 7/2000 Santacatterina et al. .... 340/588
6,104,007 A * 8/2000 Lerner ..... 219/453
2002/0113057 A1 8/2002 Lerner

* cited by examiner

*Primary Examiner*—Hung Nguyen
(74) *Attorney, Agent, or Firm*—Merchant & Gould P.C.

(57) ABSTRACT

A temperature warning system for a fireplace includes, for example, an arrangement to sense a temperature of at least one area of the fireplace and a signaling device controlled by the arrangement to provide a signal responsive to the temperature of the area. The arrangement may include an electrical circuit including a thermistor positioned outside the viewing area to measure the temperature of an area of the fireplace. The signaling device may include visual or audible signaling devices for signaling to a user when an area of the fireplace is above a threshold temperature.

12 Claims, 5 Drawing Sheets

TEMPERATURE WARNING SYSTEM FOR A FIREPLACE

TECHNICAL FIELD

The present invention relates to a fireplace. More particularly, the invention relates to a temperature warning system used with a fireplace.

BACKGROUND

Fireplaces are common in houses, apartments and businesses. They have many benefits besides providing heat, such as providing an aesthetically pleasing arrangement of flames, sounds, and smells. Fireplaces come in many arrangements, some freestanding with all sides exposed and others disposed in a wall with at least one side exposed. The majority of fireplaces include one or more doors or covers that allow access to an interior area of the fireplace to adjust controls or to provide combustible material and light the combustible material or the pilot.

This access to the fireplace, however, could create safety issues. For example, a person accessing the interior of the fireplace can be burned or otherwise injured by the flames or hot surfaces. In addition, because the fireplace produces heat, it is possible for one or more exterior surfaces of the fireplace to become heated. These potentially hot exterior surfaces of the fireplace pose a risk of burns to individuals, in particular children, or damage to objects that come into contact with the surfaces.

Current fireplace design fails to provide a clearly visible warning system that indicates to an individual that a surface of the fireplace is hot. Therefore, there is a need for a fireplace unit with a warning system that warns individuals that a fireplace surface is hot.

SUMMARY

Generally, the present invention relates to a warning device that indicates when the temperature of a fireplace surface is unsafe. More particularly, the invention relates to an apparatus measuring a temperature of an area or surface of a fireplace and indicating that temperature to an individual.

In one aspect, the invention relates to a temperature warning system for a fireplace including an arrangement to sense a temperature of at least one area of the fireplace and a signaling device controlled by the arrangement to provide a signal responsive to the temperature of the area.

In another aspect, the invention relates to a fireplace including an enclosure, an electrical circuit positioned on the fireplace to measure a temperature of at least one area of the fireplace, and a signaling device on the fireplace, controlled by the electrical circuit, to signal when the at least one area exceeds a threshold temperature.

In yet another aspect, the invention relates to a fireplace including an enclosure defining a combustion chamber and at least one opening, a front panel coupled to the enclosure and positioned to cover the opening and define a viewing area into the combustion chamber, an electrical circuit positioned outside the viewing area of the combustion chamber to measure a temperature of an area of the fireplace, and at least one light visibly mounted on the fireplace and controlled by the electrical circuit, the electrical circuit illuminating the at least one light when the area exceeds a threshold temperature.

In yet another aspect, the invention relates to a method for warning a user when a surface of a fireplace exceeds a threshold temperature, the method including steps of: measuring a temperature of an area of the fireplace; activating at least one signaling device when the area of the fireplace exceeds the threshold temperature; and turning off the at least one signaling device when the temperature of the area of the fireplace is below the threshold temperature.

In another aspect, the invention relates to a method for warning a user of a fireplace when a surface of a fireplace exceeds a threshold temperature, the method including steps of: providing a fireplace enclosure; providing an arrangement coupled to the fireplace enclosure that measures the temperature of at least one area of the fireplace; activating at least one signaling device when the area of the fireplace exceeds a threshold temperature; and turning off the signaling device when the temperature of the area of the fireplace is below the threshold temperature.

In another aspect, the invention relates to a fireplace including an enclosure defining a chamber, a means for measuring a temperature of at least one area of the fireplace, and a means for signaling when the at least one area exceeds a threshold temperature.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 1:
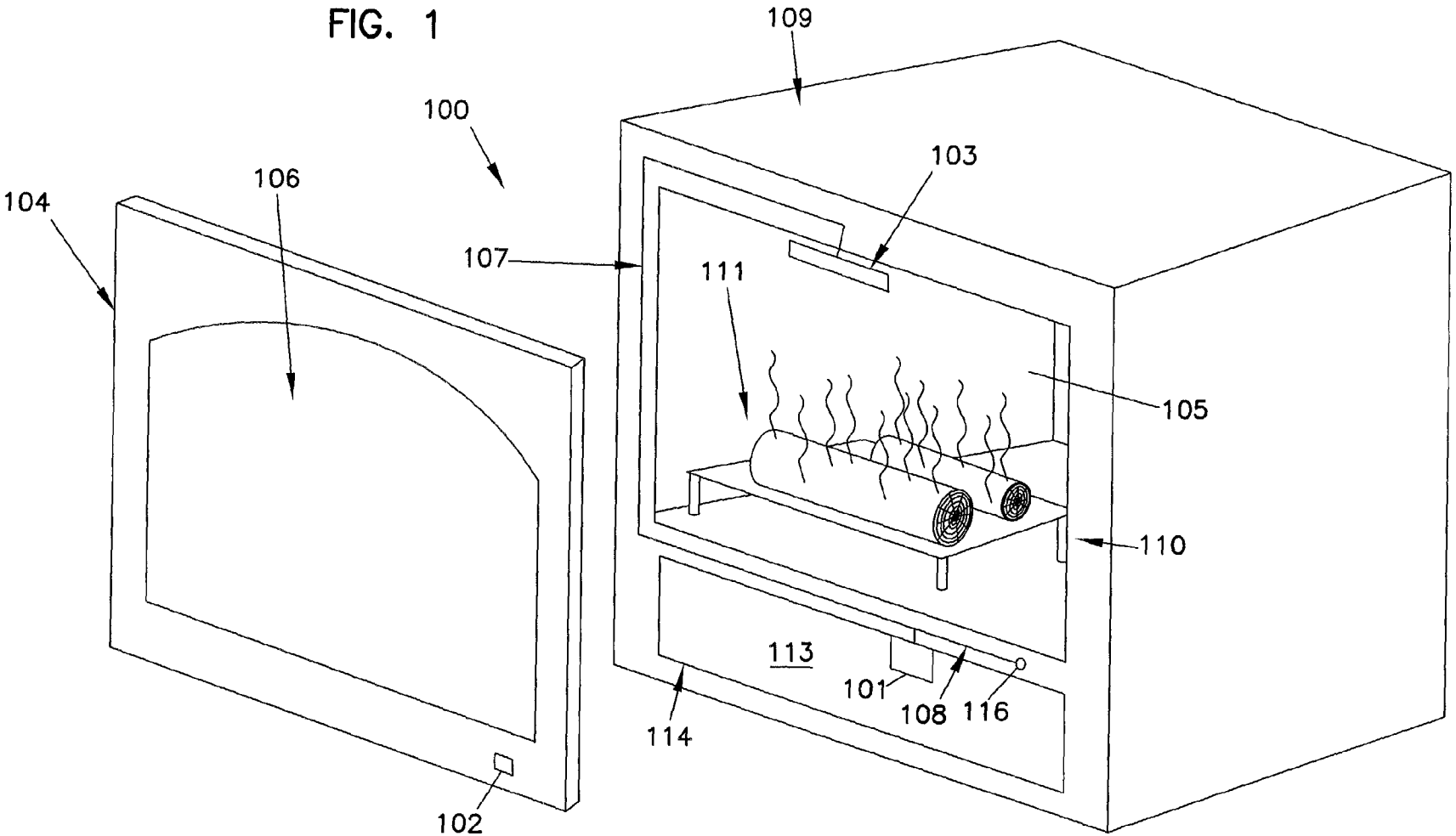
FIG. 1 is a schematic perspective exploded view of an example embodiment of a fireplace including an example temperature warning system made in accordance with the present invention.

While the invention is amenable to various modifications and alternant forms, specifics thereof have been shown by way of example and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

While the present invention is not so limited, an appreciation of the various aspects of the invention will be gained through a discussion of the examples provided below.

Generally, example embodiments of the present invention may function as a temperature warning system for a fireplace that provides a signal to an individual that an area or areas of the fireplace may be dangerous. In one embodiment, for example, an arrangement senses the temperature of a measured area of the fireplace and signals to an individual when the measured area or other areas or surfaces related to the measured area's temperature exceeds a threshold temperature, thereby warning an individual when a surface or area of the fireplace is unsafe to touch. When the area of the fireplace cools below the threshold temperature, the arrangement turns off the signaling device, indicating to an individual that the surface or area of the fireplace is again safe to touch.

The warning system may function in many ways. For example, the system may use a variety of different arrangements to measure the temperature of an area of the fireplace. Some examples of arrangements that could be used to sense the temperature of an area are electrical circuits, any number of commercially available thermometers, chemical compositions, or infrared sensors. The arrangement may be localized in one area of the fireplace or may have components away from the arrangement to measure the temperature in one or more different locals on the fireplace.

The arrangement may measure an area of the fireplace and control a signaling device according to that local or the arrangement may control the signaling device according to a different local whose temperature is related to the temperature of the measured area. The arrangement may measure, for example, multiple areas and have multiple signaling devices. For example this warning system could be used in a multi-sided fireplace, such as is disclosed in U.S. Pat. No. 5,076,254, issued to Shimek et al., which is directed to a direct vented multi-glass side fireplace and incorporated herein by reference. For example, the fireplace described in Shimek et al., containing an embodiment of the present invention, can have multiple areas whose temperature is measured and multiple signaling devices that indicate when specific surfaces of the fireplace are hot.

Additionally, the arrangement may include devices that do not require being physically connected to components of the arrangement. Parts of the warning system, for example, the thermistor or signaling device, could be wirelessly coupled, using a known wireless technology, to other parts of the warning system, such as, in one example embodiment, the electrical circuit. This could make it easier to measure the temperature of surfaces, such as covers, that at times need to be removed, because there would be no wire connecting the removable piece to the main fireplace unit.

The arrangements may be combined with one or more signaling devices. There are different embodiments of signaling devices that the system could use to signal to an individual that the measured area or measured areas have exceeded a threshold temperature. Examples of signaling devices include lights, audible alarms, numeric displays, chemical compositions whose discernable characteristics could be made to change, and any other known device or temperature indicated display that could signal a hot surface to a user. The warning system described herein could contain multiple signaling devices for use on multi sided fireplace units as described in, for example, Shimek et al. discussed above.

In addition, these signaling devices could be used in combination or have different features that could indicate different temperature ranges. For example, if the signaling device is a light, the light could be made to brighten as the temperature increases. The light could also change colors according to different temperature levels or ranges. For example, when an area or surface of the fireplace is cool the light could be blue, when the temperature of an area or surface of the fireplace approached the threshold temperature the light could be yellow and when the temperature of an area or surface of the fireplace exceeded the threshold temperature, the light could turn red.

If a plurality of lights is used, the plurality could be arranged in an array such that as the temperature of the area or surface of the fireplace increased, a greater number of lights illuminated, or the light higher in the array is illuminated. This array could also incorporate a color change. For example, the lights in the array could range in color corresponding to different temperature ranges. For example, the light at one end of the array could be blue, lights in the middle could be yellow, and lights at the opposite end the array could be red. The array could be illuminated depending on the temperature of the area. In addition, a simulated electric glowing embers system disposed within a combustion chamber of the fireplace can also be used as a signaling device, as is illustrated and described with reference to FIG. 5.

If an audible signal is used, the audible signal may have different tunes, chimes and beeps that indicate different temperature ranges. In this example the audible signal may be a steady sound that is activated once the temperature of a surface of the fireplace exceeds a threshold temperature. The volume should be sufficiently loud such that an individual can hear when they are at a distance capable of touching a surface of the fireplace. In another example using an audible signal, the audible signal may make any noise at specified intervals when the temperature of a surface of the fireplace exceeds a threshold temperature.

If a chemical composition is used, the composition must have properties such that a temperature-signaling feature of that composition changes sufficient to be perceived by an individual. For example, this chemical composition could change in color to indicate an increase in temperature. This chemical composition could be a film that is coupled to a visible portion of the fireplace so that when the temperature of an area of the fireplace rises, the film could change colors. This film could also be in many shapes. For example, it could be in the shape of the letters spelling "HOT" when the film's temperature reaches a threshold temperature or the color of the film could change from transparent to opaque, thus indicating to an individual that the surface is dangerous.

If a digital display is used, the display could have any number of features. The digital display could be a heads-up display that is projected onto the glass of the fireplace or it could be a liquid crystal display (LCD) mounted at a viewable position on the fireplace. The LCD example could be on at all times or could turn on when a surface of the fireplace exceeds a threshold temperature. The LCD example could also have a backlight that turns on when a surface of the fireplace exceeds a threshold temperature, thereby drawing individual's attention to it.

In one example embodiment of the present invention, the arrangement for measuring the temperature of an area of the fireplace is an electrical circuit. The electrical circuit could control a signaling device, for example, a light, such that when the electrical circuit measures a temperature above a threshold temperature the arrangement activates the light.

When the temperature of the measured area cools to below the threshold temperature, the circuit could turn off the light.

Now referring to FIG. 1, an example of a fireplace 100 is illustrated including an outer enclosure 109, a front panel 104, a combustion chamber 105 defined by an enclosure 110, and a burner system 111 disposed within the combustion chamber enclosure 110. The outer enclosure 109 and the combustion chamber enclosure 110 define an air plenum system 113 with an air intake 114. A grill that typically covers the air intake 114 has been removed. Other components of a typical fireplace, such as, for example, blowers, combustible gas sources, valves, burner assemblies, fresh air intakes, and exhaust air ducts have been removed from FIG. 1 to enhance clarity. Front panel 104 may be coupled to the fireplace 100 to cover the combustion chamber 105. The front panel 104 can include a glass panel 106 that allows the combustion chamber 105 to be viewed from outside the fireplace. A viewing area of the combustion chamber 105 may include any area within the enclosure 110 that is viewable from the outside of the fireplace 100.

Fireplace 100 is provided as an example only, and any other known configuration for a fireplace may also be used, such as a direct vent, a universal vent, a B-vent, a horizontal/vertical-vent, a dual direct vent, a multisided unit having two or three glass panels as combustion chamber side panels, or in any fireplace unit (gas, solid-fuel burning or electric), stove, or insert in which combustion or the generation of heat occurs. Although the term "combustion chamber" will be used throughout to reference the combustion chamber 105, the term "combustion chamber" may include any enclosure in which flames and/or heat are generated or simulated, whether the fireplace is a solid-fuel, gas, electric, or another known simulated fireplace. Further, the enclosure 110 defining the combustion chamber 105 may include more or fewer panels.

Referring to FIG. 1, the warning system includes a measuring circuit 101, a viewing area 102, a signaling device 116, a signaling device connecting wire 108, a thermistor 103 and a thermistor connection wire 107. The signaling device viewing area 102 is contained within the front panel 104. It should be noted that the signaling device viewing area 102 could be any transparent material, the glass panel 106, or a hole in the front panel 104 allowing light or sound from signaling device 116 to be seen or heard by an individual. In the present example, the signaling device 116 is a light and is coupled to the fireplace 100. The light, when activated, can be seen through the viewing area 102 on the front panel 104.

The thermistor 103 is coupled to the measuring circuit 101 by the thermistor connection wire 107. It should be noted that wire 107 is provided only as an example, and the thermistor could be coupled to the measuring circuit via a remote signal or by any other known wireless method. Thermistor 103 is coupled to the fireplace 100 and may be in intimate contact with the front panel 104 when the front panel 104, including the front panel glass 106, is coupled to the fireplace 100. It should be noted that the thermistor 103 could be placed in any position so that it can measure a temperature of any area or surface of the fireplace. The thermistor 103 may, for example, be positioned in the portion of the fireplace that is hottest.

The measuring circuit 101 is coupled to the signaling device 116 by the signaling device connecting wire 108. Notably, the measuring circuit 101 can also be coupled to the signaling device 116 using a remote signal. The measuring circuit 101 reads the temperature from the thermistor 103 and when the temperature of the thermistor 103 exceeds a threshold temperature, the measuring circuit 101 activates the signaling device 116. When the temperature of the front panel 104 drops below the threshold temperature, the measuring circuit 101 deactivates the signaling device 116. In one example embodiment according to the invention, the threshold temperature is set at 110 degrees Fahrenheit, although other threshold temperatures can also be used. It is also possible to vary the threshold temperature.

The warning system can be configured to allow the signaling device 116 to indicate that the front panel 104 is above the threshold temperature during and after heat generation in the combustion chamber 105. Alternatively, the warning system can be configured to indicate that the front panel, or any other surface, of the fireplace is above the threshold temperature following a period of heating in the combustion chamber. For example, a fireplace may be used to generate heat. During this use, the front panel heats up above the threshold temperature, but the signaling device is not activated. Heat generation by the fireplace is then terminated by the user. The signaling device then activates to indicate that the front panel is above the threshold temperature. The signaling device turns off after the fireplace cools down to a temperature below the threshold temperature. This may be advantageous, for example, because once heat generation in the fireplace has ceased, there may be no other visible indication, besides the signaling device, that the front panel is above the threshold temperature and may therefore be unsafe.

Figure 2:
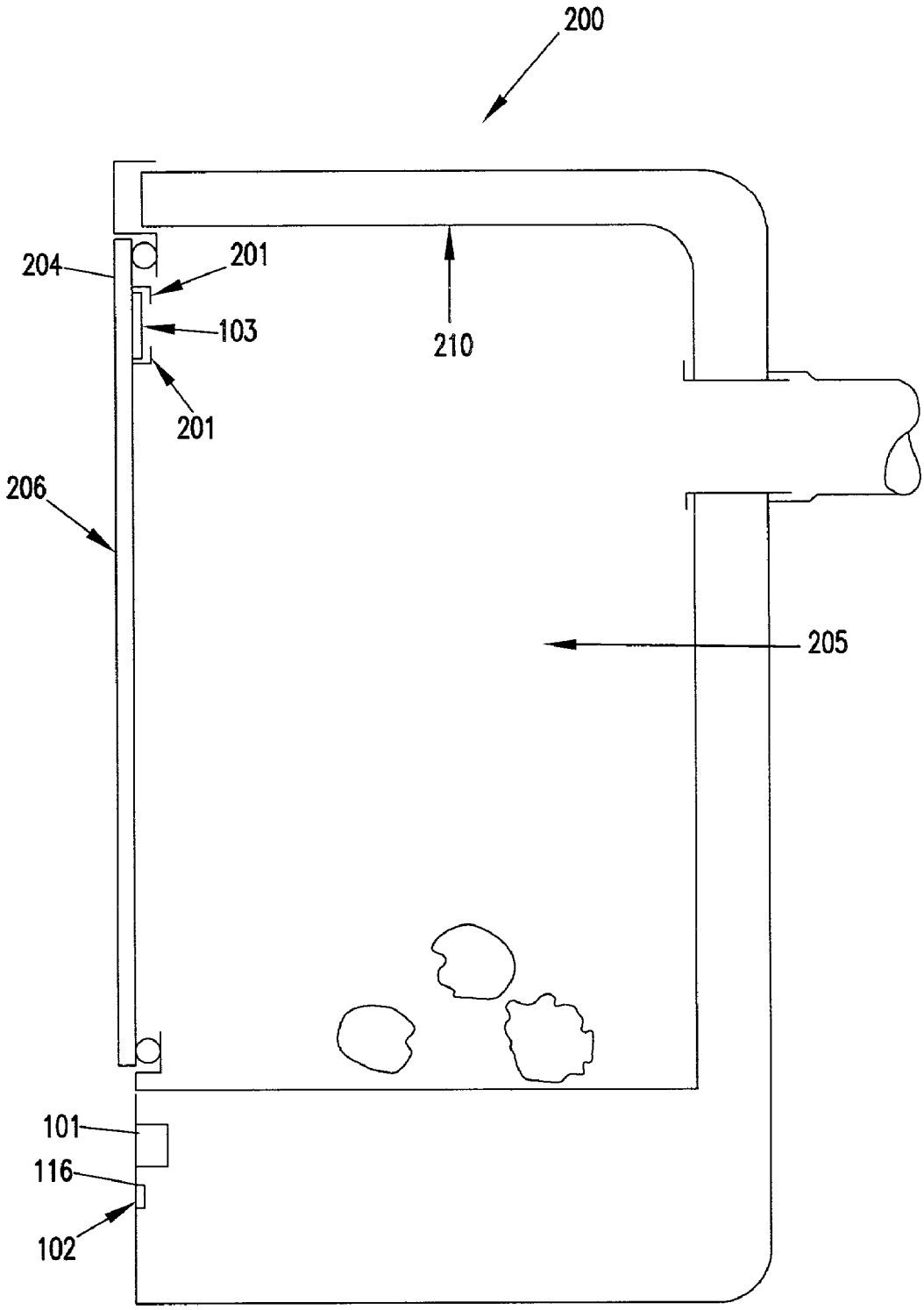
FIG. 2 is a schematic side cross-sectional view of another example embodiment of a fireplace including an example temperature warning system made in accordance with the present invention.

Referring now to FIG. 2, a cross-sectional view of another example embodiment of a fireplace 200 is shown, such as that disclosed in U.S. Pat. No. 5,996,575, issued to Shimek et al., incorporated herein by reference. FIG. 2 shows a combustion chamber enclosure 210 that defines a combustion chamber 205 with thermistor 103 coupled to a front panel 204. It should be noted that FIG. 2 is an example only and that, as described above, the thermistor 103 can be placed in any location on or in the fireplace 200 to measure a temperature of an area or surface that is indicative of a surface or area that could be dangerous to an individual. The thermistor 103 is attached to the front panel 204 by brackets 201. It should also be noted that, although the thermistor 103 is shown as being attached to the front panel 204 in the example embodiment illustrated, the thermistor 103 may be placed on the front panel 204 or the panel glass 206 such that it may be out of an individual's sight when looking at the fireplace during normal operating conditions. The thermistor 103 could also be attached using adhesive, tape, fasteners, and other connecting devices.

Figure 3:
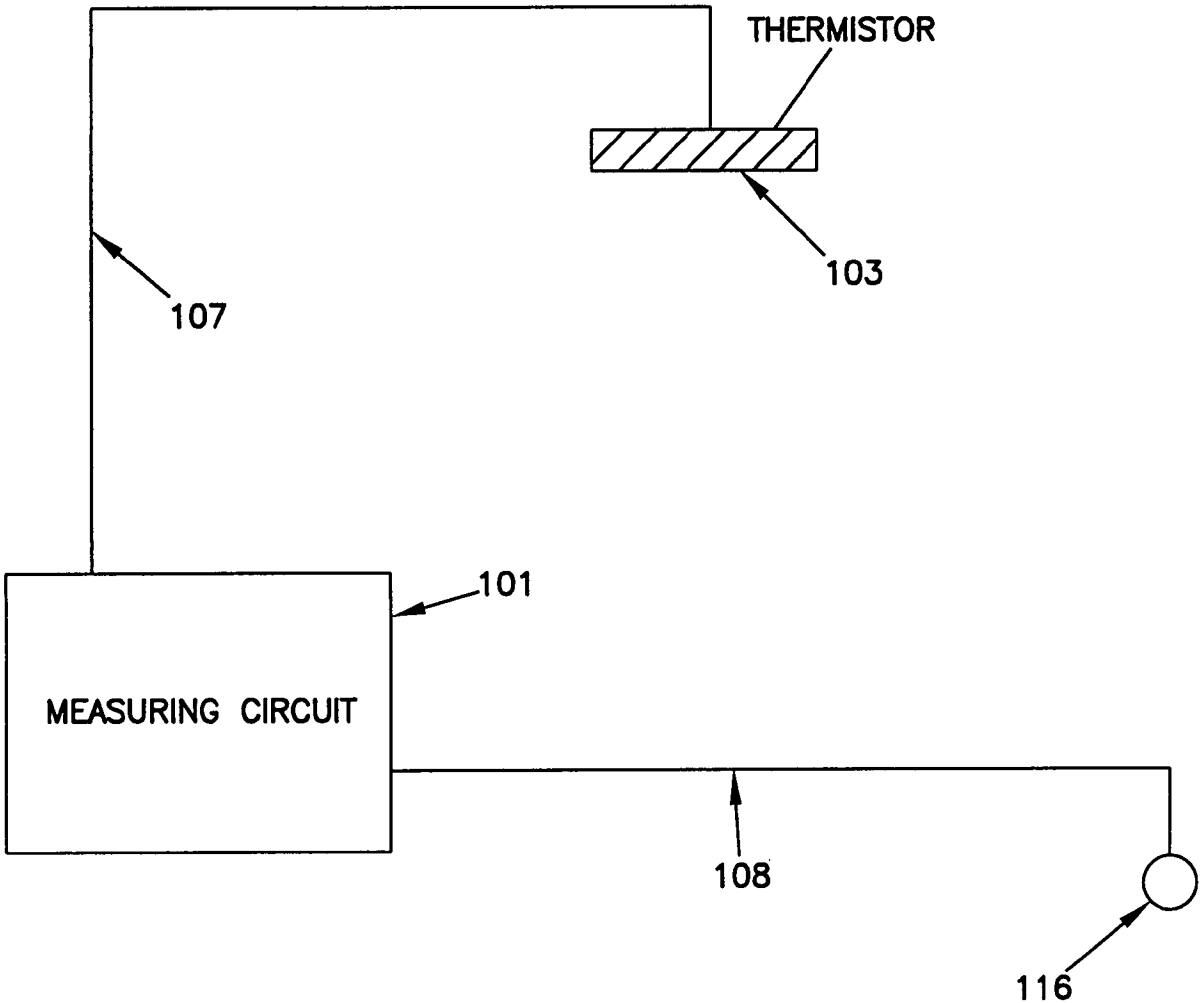
FIG. 3 is a schematic plan view of an example embodiment of a temperature warning system including a measuring circuit, thermistor and indicator made in accordance with the present invention.

FIG. 3 is a plan view of an example embodiment of a temperature warning system as illustrated in the example fireplaces 100 and 200 of FIGS. 1 and 2. FIG. 3 includes the signaling device 116 coupled to the measuring circuit 101 by the indicator connecting wire 108. The thermistor 103 is coupled to the measuring circuit 101 by the thermistor connecting wire 107. The thermistor 103 can be placed on or near any surface that would be appropriate to warn an individual that the surface, or any other related area or surface, could be hot.

Figure 4:
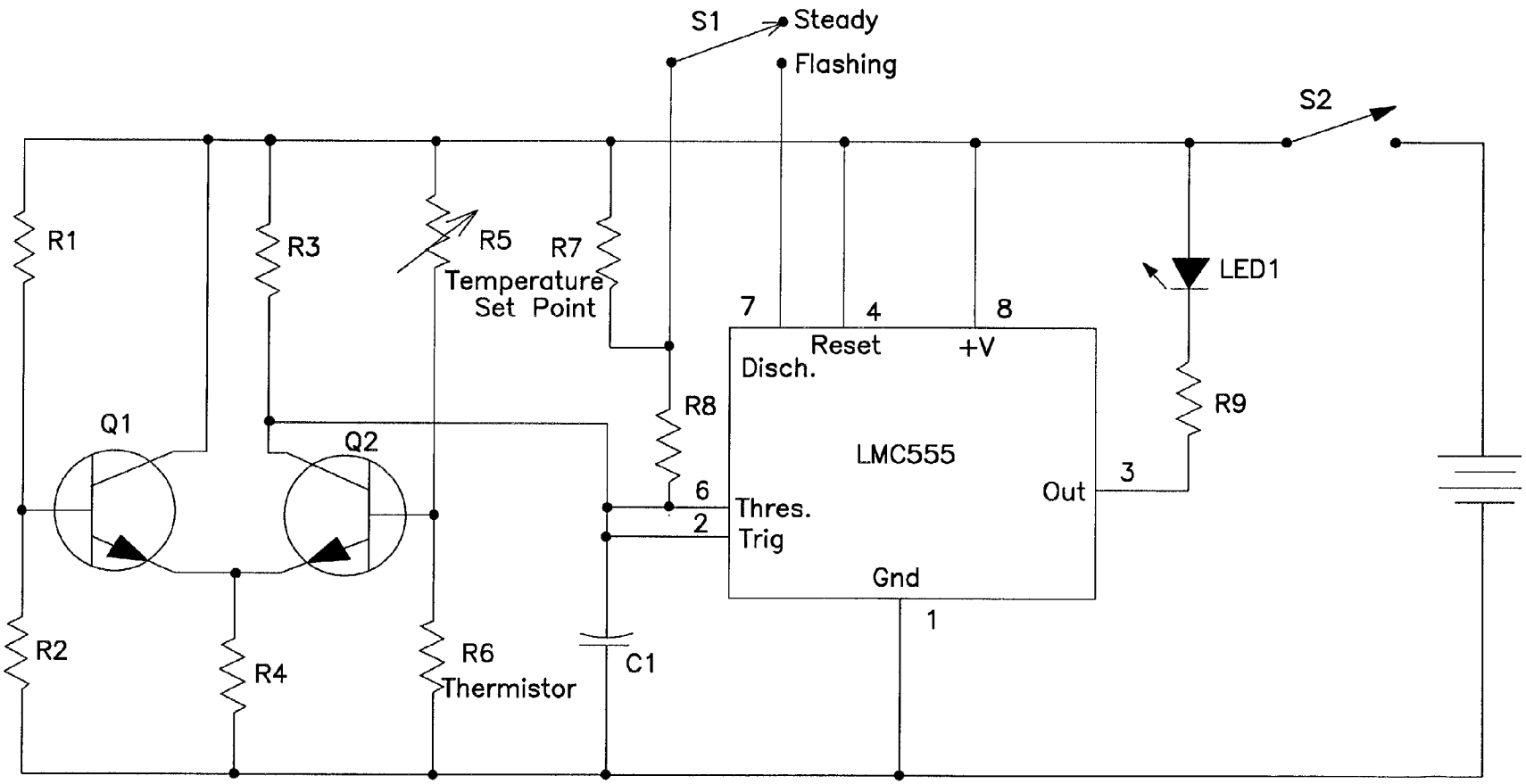
FIG. 4 is a schematic view of example electrical components of an example embodiment of a temperature warning system made in accordance with the present invention.

FIG. 4 is a schematic of an example embodiment of electrical components that may be used to create an example warning system made in accordance with the invention. Resistors R1 and R2 form a voltage divider for a reference ratio. Transistors Q1 and Q2 and resistor R4 form a temperature-compensated comparator. The temperature sensing thermistor R6 and the temperature set point resistor R5 form a voltage divider. When the thermistor R6 is cold, its resistance is high so that the voltage at the base of Q2 is high and the Q2 collector will be pulled towards ground. An LMC555 CMOS timer, from National Semiconductor of Santa Clara, Calif., is coupled to capacitor C1 that will be held in a discharged state so that the LMC555 output will be held high, keeping LED1 turned off.

When the thermistor R6 is heated due to its location on the fireplace, its resistance will decrease and when the resistance is lower than a threshold value set by the variable resistor R5 and the ratio of R1 and R2, the base voltage of Q2 will decrease. This will allow the collector voltage of Q2 to rise until the voltage on capacitor C1 is above the threshold voltage of the LMC555, which will make the output go low. This will cause current to flow through LED 1, limited by resistor R9.

If the switch S1 is in the steady position, capacitor C1 will have no discharge path, and the output of the LMC555 will remain low. Alternatively, if the switch S1 is in the flashing position, capacitor C1 will be discharged by pin 7 of the LMC555 through resistor R8 until the trigger pin 2 of the LMC555 reaches its trigger point, whereupon the LMC555 pin 7 will be released. This will allow the capacitor to start to charge and the output pin 3 will go high, turning off LED 1, and the cycle will repeat.

When the fireplace is turned off and the thermistor cools below the set point temperature, the collector of Q2 will again be pulled low, the light will go out and stay out until the thermistor is heated again. It should be noted that a comparator circuit could replace the circuitry represented by R4, Q1 and Q2. It is desirable to keep one side of the thermistor R6 at ground potential should the shield in the cable going to the thermistor were to short to ground and also so that a three-volt supply existing in some units could be used to supply power.

A switch S2 is also provided that may be used to turn the warning system on (closed position) and off (open position).

Figure 5:
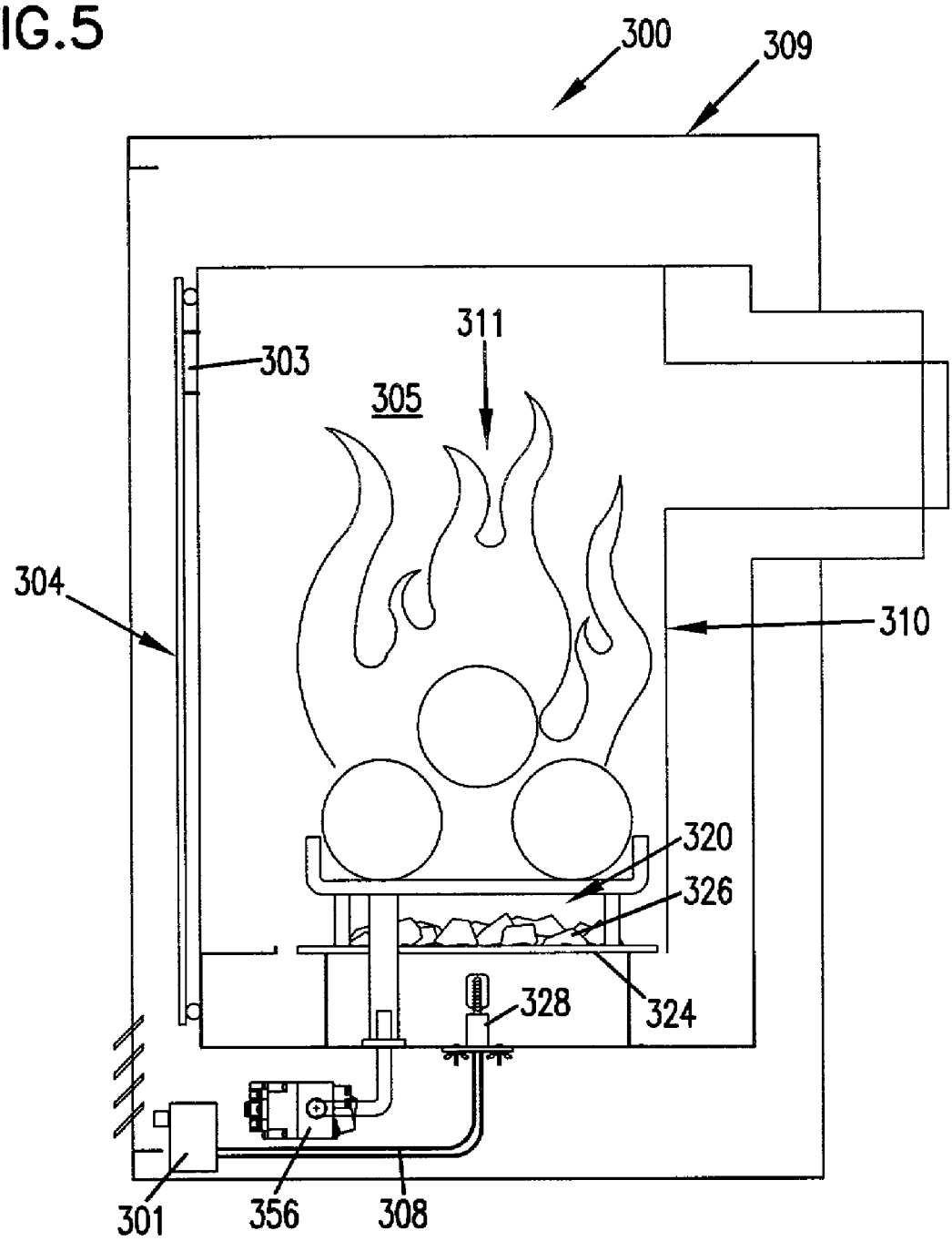
FIG. 5 is a schematic side cross-sectional view of another example embodiment of a fireplace including an example temperature warning system and an example simulated electric glowing embers system made in accordance with the present invention.

Referring now to FIG. 5, a cross-sectional view of another example embodiment of a fireplace 300 is shown made in accordance with the present invention. The fireplace 300 is similar to that of the other example fireplaces 100 and 200, including an outer enclosure 309, a front panel 304, a combustion chamber 305 defined by an enclosure 310, and a burner system 311 disposed within the combustion chamber enclosure 310. A combustible gas control valve 356 is also shown.

The fireplace 300 also includes a simulated electric glowing embers system 320 disposed within the combustion chamber 305. The simulated electric glowing embers system 320 includes a support structure 324, a plurality of translucent artificial embers 326 disposed upon the support structure 324, and light source 328. Light from the light source 328 can pass through the support structure 324 and illuminate the translucent artificial embers 326, thereby creating a glowing effect.

Also included with the fireplace 300 is a warning system comprising a measuring circuit 301 and a thermistor 303. The thermistor 303 is coupled to the measuring circuit 301 by a thermistor connection wire (not shown). The measuring circuit 301 is, in turn, coupled to the light source 328 of the simulated electric glowing embers system 320 by the signaling device connecting wire 308. As a temperature of, for example, the front panel 304 increases, as measured by the thermistor 303, the measuring circuit 301 may control the light source 328, causing the light to increase in intensity and/or color, thereby varying the intensity and/or color of the translucent artificial embers 326. For example, the glow of the translucent artificial embers 326 may increase in intensity or change color as the heat within the fireplace 300 increases and then reduce in intensity or change color as the heat generated by fireplace diminishes. The increase in intensity of the glow of the translucent artificial embers 326 may function as a warning that one or more surfaces of the fireplace 300, such as the front panel 304, may be hot. The translucent artificial embers 326 may continue to glow after stopping combustion within the fireplace 300 and until the temperature of the front panel 304 falls below the threshold temperature.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A temperature warning system for a fireplace, the system comprising:

an arrangement to sense a temperature of at least one area of the fireplace; and a signaling device controlled by the arrangement to provide a signal responsive to the temperature of the area wherein the signaling device is a glowing ember bed.

2. The system as in claim 1, wherein the arrangement is an electrical circuit.

3. The system as in claim 1, wherein the signaling device also includes at least one light.

4. The system of claim 1, wherein the signaling device also includes an audible alarm.

5. The system as in claim 1, wherein the glowing ember bed glows when the glowing ember bed reaches a threshold temperature to indicate to a user that the area is hot.

6. The system as in claim 5, wherein an intensity of the glow is related to the temperature of the at least one area.

7. The system as in claim 5, wherein the glowing ember bed stops glowing when the temperature of the at least one area of the fireplace is below a threshold temperature.

8. The system as in claim 1, wherein the arrangement to sense temperature senses the temperature of a front panel of the fireplace.

9. A fireplace comprising:

an enclosure;

an electrical circuit coupled to the fireplace to measure a temperature of at least one area of the fireplace; and a signaling device on the fireplace, controlled by the electrical circuit, to signal when the at least one area exceeds a threshold temperature, wherein the signaling device is a glowing ember bed.

10. The fireplace as in claim 9, wherein the signaling device also includes at least one light.

11. A method for warning a user when a surface of a fireplace exceeds a threshold temperature, the method comprising the steps of:

measuring a temperature of an area of the fireplace;

activating at least one signaling device only when the area of the fireplace exceeds the threshold temperature and generation of heat within the fireplace has been terminated;

turning off the at least one signaling device when the temperature of the area of the fireplace is below the threshold temperature; and wherein the at least one signaling device is a glowing ember bed.

12. The method as in claim 11, wherein the measuring step comprises a step of using an electrical circuit to measure the temperature of the area of the fireplace.

* * * * *